US006450069B1

(12) United States Patent
Brahmbhatt

(10) Patent No.: US 6,450,069 B1
(45) Date of Patent: Sep. 17, 2002

(54) MULTI-PURPOSE WRENCH FOR USE ON GAS CYLINDERS

(76) Inventor: Sudhir R. Brahmbhatt, 1700 Country Top Ct., Glencoe, MO (US) 63038-1446

( * ) Notice: Subject to any disclaimer, the term of this patent is extended or adjusted under 35 U.S.C. 154(b) by 0 days.

(21) Appl. No.: 09/891,719

(22) Filed: Jun. 26, 2001

(51) Int. Cl.[7] ..... B25B 13/48
(52) U.S. Cl. ..... 81/176.2; 81/124.4; 81/125.1
(58) Field of Search ..... 81/176.1, 176.15, 81/176.2, 121.1, 124.4, 125.1, 60

(56) References Cited

U.S. PATENT DOCUMENTS 1,796,083 A * 3/1931 Carlberg ..... 81/125.1
2,515,558 A * 7/1950 Kluth ..... 81/176.15
2,605,665 A * 8/1952 Grenat ..... 81/124.4
5,522,287 A * 6/1996 Chiang ..... 81/60
6,076,435 A * 6/2000 White, Sr. et al. ..... 81/176.2

* cited by examiner

*Primary Examiner*—Eileen P. Morgan
*Assistant Examiner*—Joni B. Danganan
(74) *Attorney, Agent, or Firm*—Polster, Lieder, Woodruff & Lucchesi, L.C.

(57) ABSTRACT

A multi-purpose wrench (10) used to open valves (V) on gas cylinders of various sizes. An elongate handle (12) has a ratchet formed at one end (12*a*). A socket (14) mounts on the ratchet and has a plurality of openings (20*a*,22*a*, 20*b*,22*b*) formed on opposite surfaces (18*a*, 18*b*) for engaging the stem of a valve (V3, V4) to open and close the valve. A disc (26) is attached to a ratchet (24) adjacent the other end of the handle to open gas cylinders of a different size. The disc includes a plurality of pins (28) which engage differently shaped wheels of valves (V1, V2) the wrench to open the valve when rotated.

13 Claims, 2 Drawing Sheets

MULTI-PURPOSE WRENCH FOR USE ON GAS CYLINDERS

CROSS REFERENCE TO RELATED APPLICATIONS

STATEMENT REGARDING FEDERALLY SPONSORED RESEARCH OR DEVELOPMENT

BACKGROUND OF THE INVENTION

This invention relates to tools; and more particularly, to a wrench for use in opening and closing gas cylinders of various sizes and with different valve wheel or valve stem constructions.

Gas cylinders or tanks are used in many environments, in hospitals and laboratories, and to some extent in people's homes. Industrial cylinders used in the former environments contain many types of gases some of which are extremely dangerous. Medical cylinders used in a person's home or a custodial environment (a nursing or extended care facility) most often are (E, MC, or MB) type cylinders filled with oxygen to assist someone's breathing.

Regardless of the environment, there are problems associated with each type of usage. In the hospital/laboratory setting, the gas cylinders are very tightly closed so to avoid any leakage prior to use. Such cylinders are difficult to open and usually cannot be opened by hand. If no tool is available, as sometimes happens, then the user is stymied until a tool is located. Once a tool is located, then the problem is one of making sure not to break the stem of the valve by which the cylinder is opened and closed. Typically the tool is only used to open the cylinder with the cylinder then subsequently being closed by hand.

In home settings, the cylinders are often connected to tubing by which oxygen, when the tank is opened, will flow into a mask (or directly into a patient's nostrils) to enhance the person's breathing. Usually the person does not continually need the oxygen so the cylinder is regularly being opened and closed. Now the problem is the strength of the patient or caregiver to open the cylinder and then close it sufficiently tight so there is not an oxygen leak. Otherwise, the cylinder may be empty at a time when the patient needs oxygen.

BRIEF SUMMARY OF THE INVENTION

Among the several objects of the present invention may be noted the provision of a multi-purpose wrench which can be used on a variety of gas cylinders and in a wide range of environments. In hospital and laboratory settings the wrench only is needed to open a valve with care being taken that the valve stem not be broken when the valve is opened, resulting in a leak. In home or similar settings, a wrench is needed to both open and close the cylinder. The wrench must be easy to use especially by those who are ill and not as capable of physical exertion as others might be. The multi-purpose wrench of the present invention provides this capability. The wrench has a handle with a ratchet on one end to which a socket attaches. The socket has a plurality of openings formed on opposite faces of the socket. One opening on each face corresponds in size and shape to a corresponding opening on the opposite face, and these respective pairs of openings allow the wrench to be used to both open and close a cylinder. A disc from which a plurality of pins extend fits onto a ratchet located adjacent the other end of the wrench. The pins engage various types of valve wheels employed with valves installed on larger type cylinders. The disc allows the wrench to turn the valve wheel in only one direction so to open the valve. Other features will be in part apparent and in part set forth hereinafter.

BRIEF DESCRIPTION OF THE SEVERAL VIEWS OF THE DRAWINGS

The objects of the invention are achieved as set forth in the illustrative embodiments shown in the drawings which form a part of the specification.

FIG. 2 is a side elevation view of the wrench;

Corresponding reference characters indicate corresponding parts throughout the several views of the drawings.

DETAILED DESCRIPTION OF INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. As various changes could be made in the above constructions without departing from the scope of the invention, it is intended that all matter contained in the above description or shown in the accompanying drawings shall be interpreted as illustrative and not in a limiting sense.

Figure 4:
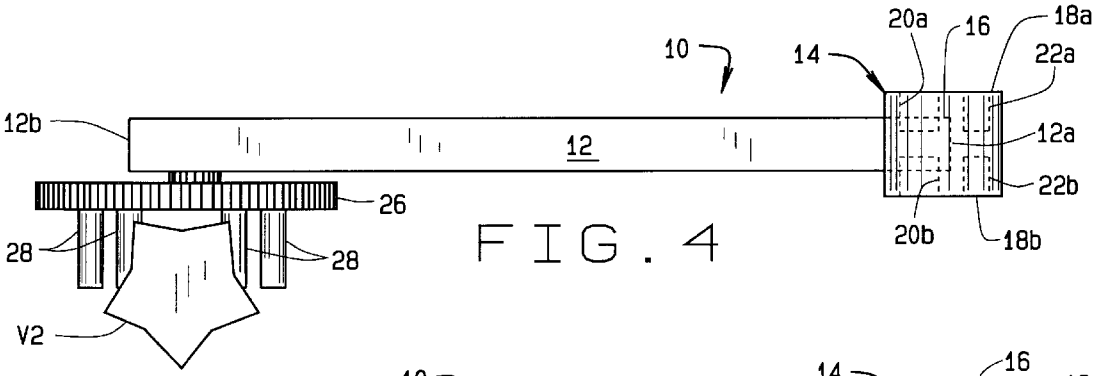
Figure 5:
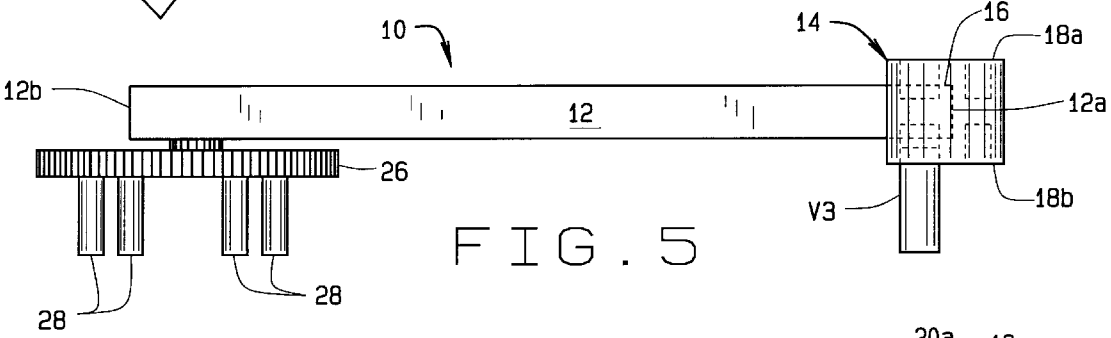
FIGS. 5 and 6 illustrate use of the wrench to open and close smaller gas cylinders.
Figure 6:
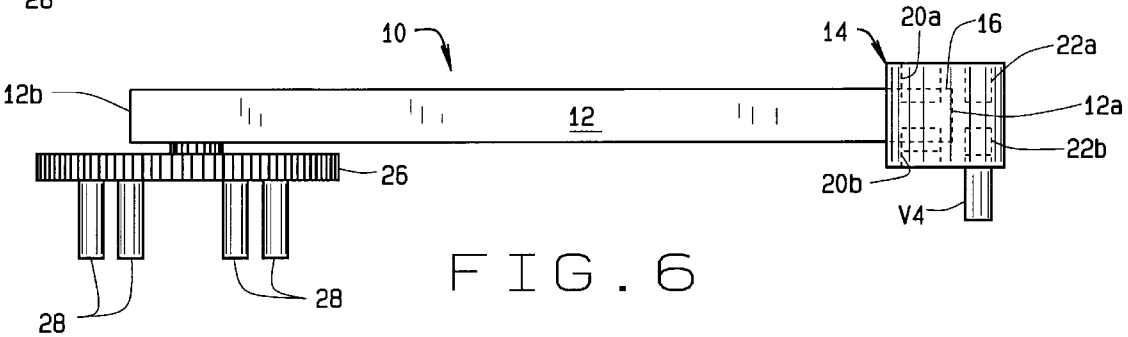

Referring to drawings, a multi-purpose wrench 10 of the present invention is for use in opening a valve V on a gas cylinder. The gas cylinders, as indicated in the Background portion of this Specification are available in various sizes depending upon a particular usage and the type of gas stored in the cylinder. For example, in FIG. 3, a valve V1 has a valve stem whose top wheel is multi-angled or polygonal in shape. In FIG. 4, a second valve V2 has a pentagonal shape top wheel. The valves V1 and V2 are employed on large size gas cylinders. In FIG. 5, a valve V3 for an E-type medical cylinder is shown to have a rectangular shaped stem. A smaller sized, square shaped stem V4 is shown in FIG. 6 for an MC or MB type cylinder. It is a feature of the present invention that wrench 10 can be used to open each valve V1–V4, as well as other valves not shown, without having to remove or replace any component parts of the wrench.

Figures 1, 2A, 2B, 3:
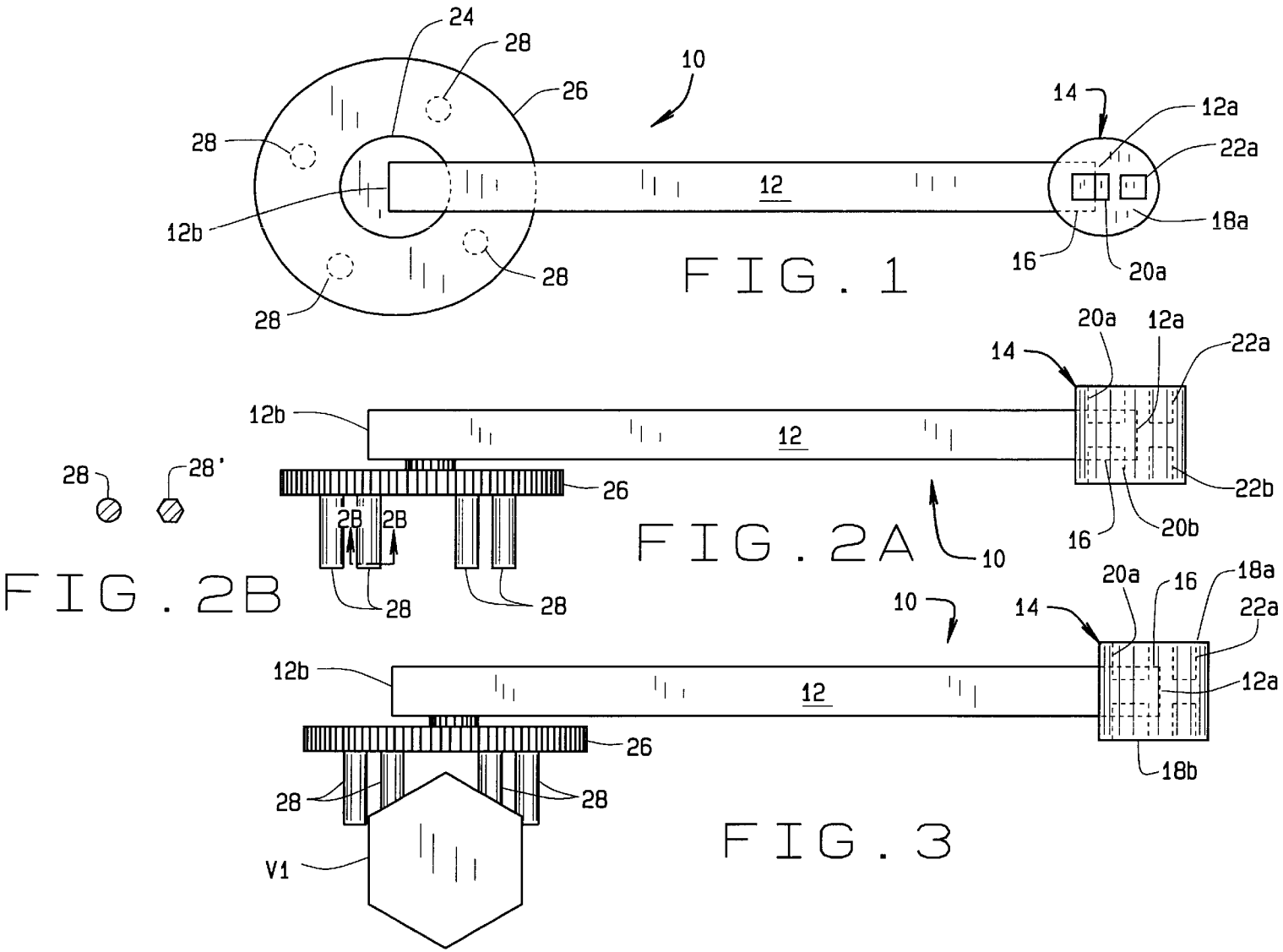
FIG. 1 is a top plan view of a multi-purpose wrench of the present invention for use with gas cylinders.
FIGS. 3 and 4 illustrate use of the wrench to open large gas cylinders.

Wrench 10 first includes an elongate handle 12 having a ratchet wheel formed at one end 12*a* of the handle. A socket 14 is shown in FIG. 1 to be circular in plan and to have a thickness greater than that of the handle. The socket has an opening 16 sized so the socket is received on ratchet end 12*a* of the handle. The socket has an upper surface 18*a* and a lower surface 18*b*. Two openings are formed in both the upper surface and lower surface of the socket. These openings are different in size, but each opening formed in the upper surface has a corresponding opening formed in the lower surface. The respective corresponding openings form pairs of openings 20, 22. A first pair of openings 20*a*, 20*b* are sized to accommodate the stem of valve V3 (see FIG. 5), with the second pair of openings being sized to accommodate the stem of valve V4 (see FIG. 6). In use, the appropriate opening (20*a* or 22*a*) is fitted onto the appropriate stem of the valve (v3 or V4). Then, by turning handle 12, the stem is rotated to open the valve and the cylinder. Since the ratchet at end 12*a* of the handle rotates in only one direction; to close the valve, the wrench is inverted and the appropriate opening (20*b* or 22*b*) is fitted onto the stem and the handle is rotated (now in the opposite direction) to close the valve.

It will be understood by those skilled in the art that socket 14 can be of a different size than that shown in the drawings so as to accommodate additional openings in its top and bottom surfaces. This allows wrench 10 to be used to open other gas cylinders. Also, socket 14 can be interchangeable with other sockets having different shaped openings which allow engagement with stems having other polygonal shapes; pentagonal, hexagonal, or octagonal, for example.

At the other end 12*b* of handle 12, a ratchet 24 is installed adjacent the end of the handle. A disc 26 is attached to this ratchet. A plurality of pins 28 are mounted on disc 26 so to engage the wheel of a valve V1 or V2 as shown in FIGS. 3 and 4. When the wrench is used, the pins either straddle the valve wheel so that they bear against the outside perimeter of the wheel. Or, if the wheel has spokes, the pins may fit into the openings between the spokes and bear against the spokes when the wrench is turned. While four pins 28 are shown in the drawings, it will be understood that more or fewer pins could be employed. The arrangement of pins on the disc is such as to enable the wrench to be used to open cylinders having a number of different wheel shapes so only one type tool needs to be employed in a hospital or laboratory to open a number of different cylinders. Unlike socket 14 which enables valves to be both opened and closed, ratchet 24 permits disc 26 to only turn in the direction to open a cylinder valves. As pointed in the Background portion of the application, the types of gas cylinders with which this end of wrench 10 is used are very tightly sealed and a significant force is required to crack open the valves. Thereafter, however, the valves are closed by hand.

Those skilled in the art will appreciate that while the pins 28 are round pins, there outer surfaces could have other contours such as a polygonal shape 28 as shown in FIG. 2. Also, while the pins are shown to be uniformly positioned about the disc, other pin arrangement can also be employed without departing from the scope of the invention.

In view of the above, it will be seen that the several objects and advantages of the present invention have been achieved and other advantageous results have been obtained.

Having thus described the invention, what is claimed and desired to be secured by Letters Patent is:

1. A multi-purpose wrench for use in opening valves on gas cylinders of various sizes comprising:

a handle;

a socket attached to one end of the handle and engaging the stem of a valve of a gas cylinder one size to open and close the valve, the socket including a plurality of openings sized to fit different valve stems so the wrench can be used on different cylinders, the socket having an upper surface and a lower surface with an opening of the same size and shape formed in each surface whereby when a valve stem is fitted into one of the openings and the wrench is turned the valve is opened, and when the valve stem is fitted into the corresponding opening in the opposite surface of the socket and the wrench is turned, the valve is closed; and, a disc attached to the other end of the handle for opening gas cylinders of a different size, the disc including at least one pin which engages a valve wheel of the cylinder for the wrench to rotate the wheel and open the valve.

2. The wrench of claim 1 wherein the end of the handle onto which the socket is fitted comprises a ratchet.

3. The wrench of claim 1 wherein the disc includes a plurality of pins attached to thereto and extending from the disc, the pins being spaced about the disc in a predetermined pattern to facilitate engagement of the pins with differently shaped valve wheels for the cylinder to be opened when the pins engage with the wheel and the wrench is turned in the appropriate direction.

4. The wrench of claim 3 wherein the pins are round pins.

5. The wrench of claim 3 wherein the pins have a polygonally shaped contour.

6. The wrench of claim 3 having four pins equidistantly spaced about the disc.

7. A multi-purpose wrench for use in opening valves on gas cylinders of various sizes comprising:

a handle;

a socket attached to one end of the handle and engaging the stem of a valve of a gas cylinder one size to open and close the valve;

a disc attached to the other end of the handle for opening gas cylinders of a different size, the disc including at least one pin which engages a valve wheel of the cylinder for the wrench to rotate the wheel and open the valve; and, a ratchet installed adjacent the other end of the handle, the disc being mounted on the ratchet.

8. A multi-purpose wrench for use in opening valves on gas cylinders of various sizes comprising:

an elongate handle on one end of which a ratchet is formed and adjacent the opposite end thereof a ratchet is attached;

a socket connected to the end of the handle on which the ratchet is formed, the socket having a plurality of openings therein for engaging the stem of a valve for a gas cylinder of one size to open and close the valve; and, a disc attached to the ratchet adjacent the other end of the handle for opening gas cylinders of a different size, the disc including a plurality of pins which engage one of a number of differently shaped valve wheels for the wrench to rotate the heel and open the valve.

9. The wrench of claim 8 wherein the socket has an upper surface and a lower surface with an opening of the same size and shape formed in each surface whereby when a valve stem is fitted into one of the openings and the wrench is turned the valve is opened, and when the valve stem is fitted into the corresponding opening in the opposite surface of the socket and the wrench is turned, the valve is closed.

10. The wrench of claim 9 wherein the pins are spaced about the disc in a predetermined pattern to facilitate engagement of the pins with a valve wheel.

11. The wrench of claim 10 wherein the pins are round pins.

12. The wrench of claim 10 wherein the pins have a polygonally shaped contour.

13. The wrench of claim 8 including four pins for engaging a valve wheel.

* * * * *

UNITED STATES PATENT AND TRADEMARK OFFICE

CERTIFICATE OF CORRECTION

PATENT NO. : 6,450,069 B1
DATED : September 17, 2002
INVENTOR(S) : Sudhir R. Brahmbhatt It is certified that error appears in the above-identified patent and that said Letters Patent is hereby corrected as shown below:

Column 2,
Line 46, please delete “heel” and insert -- wheel --.

Signed and Sealed this

Twenty-fifth Day of February, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,450,069 B1
DATED : September 17, 2002
INVENTOR(S) : Sudhir R. Brahmbhatt It is certified that error appears in the above-identified patent and that said Letters Patent is hereby corrected as shown below:

Column 4,
Line 46, please delete “heel” and insert -- wheel --.

Signed and Sealed this

Nineteenth Day of August, 2003

JAMES E. ROGAN
*Director of the United States Patent and Trademark Office*